US006626167B2

(12) United States Patent
Kim et al.

(10) Patent No.: US 6,626,167 B2
(45) Date of Patent: Sep. 30, 2003

(54) DIAMOND TOOL

(75) Inventors: Soo Kwang Kim, Irvine, CA (US); So Young Yoon, Seoul (KR); Jong Ho Kim, Seoul (KR)

(73) Assignees: Ehwa Diamond Industrial Co., Ltd. (KR); General Tool, Inc., Irvine, CA (US)

( * ) Notice: Subject to any disclaimer, the term of this patent is extended or adjusted under 35 U.S.C. 154(b) by 0 days.

(21) Appl. No.: 09/989,600

(22) Filed: Nov. 20, 2001

(65) Prior Publication Data

US 2003/0089364 A1 May 15, 2003

(30) Foreign Application Priority Data

Sep. 28, 2001 (KR) ..... 2001-60680

(51) Int. Cl.[7] ..... B28D 1/04
(52) U.S. Cl. ..... 125/15; 451/540; 451/548
(58) Field of Search ..... 125/12, 15, 13.01, 125/16.01, 18, 20–22; 451/527, 529, 533, 540, 542, 544, 548

(56) References Cited

U.S. PATENT DOCUMENTS 6,039,641 A * 3/2000 Sung ..... 451/540
6,286,498 B1 * 9/2001 Sung ..... 125/12
6,450,870 B2 * 9/2002 Ito ..... 451/542
6,453,899 B1 * 9/2002 Tselesin ..... 125/15

* cited by examiner

*Primary Examiner*—Lee D. Wilson
*Assistant Examiner*—David B. Thomas
(74) *Attorney, Agent, or Firm*—Webb Ziesenheim Logdson Orkin & Hanson, P.C.

(57) ABSTRACT

A segment type diamond tool, used for cutting or drilling brittle substances, such as stones, bricks, concrete structures, or asphalt structures, is disclosed. In the diamond tool, the segments are each set with diamonds in a single-layered structure or a multi-layered structure, and are alternately or intermittently arranged on a steel core, different from conventional diamond tools having segments randomly set with diamonds. Such a diamond arrangement of this invention allows the diamonds to more effectively perform their cutting action, and so the diamond tool has an increased cutting rate, in addition to reducing the amount of fine debris generated during a cutting or drilling process to ill-affect worker's health or cause environmental pollution. In the segments each set with diamonds in the single-layered or multi-layered structure, the diamond arrangement is designed such that the diamonds of each trailing segment form grooves on the surface of a brittle substance along the lands between grooves previously formed on the surface of the brittle substance by the diamonds of a leading segment.

11 Claims, 14 Drawing Sheets

DIAMOND TOOL

BACKGROUND OF THE INVENTION

1. Field of the Invention

The present invention relates, in general, to segment type diamond tools typically used for cutting or drilling brittle substances, such as stones, bricks, concrete structures, or asphalt structures, and, more particularly, to a diamond tool designed to increase the cutting rate while reducing the amount of fine debris generated during a cutting process.

2. Description of the Prior Art

As well known to those skilled in the art, diamond is an extremely hard form of carbon, crystallized in the form of an isometric structure, and so diamond may be preferably used in a cutting or drilling tool. Artificial diamond was developed in 1950s, and has been widely used in place of expensive natural diamond.

Particularly, the artificial diamond (herein below, referred to simply as "diamond") has been more preferably and widely used in the stone cutting field for cutting or grinding a variety of stones, such as granite or marble, and in the construction field for cutting or grinding concrete structures.

A segment type diamond tool typically comprises a plurality of segments each set with diamonds, and a steel core holding the segments thereon.

FIG. 1 is a view of an example of conventional segment type diamond tools.

As shown in FIG. 1, the segment type diamond tool 1 comprises a plurality of segments 11 and 12 regularly fixed along the outer edge of a disc-shaped steel core 2, with diamonds 5 randomly set in each of the segments 11 and 12.

When cutting a brittle substance using such a diamond tool 1, the diamonds of each segment perform their cutting action on the substance.

In accordance with studies and experiments performed by the inventors of this invention, it has been noted that the cutting rate of a diamond tool is undesirably reduced when the diamonds are randomly set on the segments of the tool.

Such a reduction in the cutting rate of a diamond tool, with segments each randomly set with diamonds, occurs for the following reasons. First, the lands between grooves formed on the surface of a brittle substance by the diamonds of a leading segment are remarkably larger in width than the diamond size, and so it is almost impossible for the diamond tool to completely remove the lands from the surface of the brittle substance even when the diamonds of a trailing segment pass along the lands. Second, some diamonds of a trailing segment may pass along the grooves previously formed on the surface of the brittle substance by a leading segment, and so such diamonds on the trailing segment do not perform any work.

The segment, randomly set with diamonds, has been typically produced through a powder metallurgy, in which diamonds are mixed with metal powder to form a mixture prior to a sintering process.

That is, in the conventional powder metallurgy for producing segments for diamond tools, diamonds are mixed with metal powder prior to a forming process and a sintering process. However, it is almost impossible for the diamonds to be uniformly distributed to the metal powder due to differences in mesh size and specific weight between the diamonds and the metal powder. Therefore, each segment of a diamond tool may be segregated with diamonds densely provided on an area 3 and sparsely provided on another area 4, thus arising the problem of random distribution of diamonds.

In such a case, the diamond tools are reduced in cutting rate and wear performance.

SUMMARY OF THE INVENTION

Accordingly, the present invention has been made keeping in mind the above problems occurring in the prior art, and an object of the present invention is to provide a segment type diamond tool, which is appropriately set with diamonds on its segments so as to have an increased cutting rate, in addition to reducing the amount of fine debris generated during a cutting process.

In order to accomplish the above object, the present invention provides a diamond tool, comprising: a plurality of segments each set with diamonds in a single-layered structure or a multi-layered structure, the diamonds of the segments being arranged such that the diamonds of each trailing segment form grooves on the surface of a brittle substance along the lands between grooves previously formed on the surface of the brittle substance by the diamonds of a leading segment.

BRIEF DESCRIPTION OF THE DRAWINGS

The above and other objects, features and other advantages of the present invention will be more clearly understood from the following detailed description taken in conjunction with the accompanying drawings, in which:

FIGS. 5 to 9 are views showing diamond arrangements of segments of diamond tools according to different embodiments of the present invention, wherein FIG. 5 is a view showing an arrangement and cutting pattern of leading and trailing segments of the diamond tool of FIG. 2 when the tool is used for cutting the surface of a brittle substance;

FIG. 6 is a view showing an arrangement and cutting pattern of a diamond tool provided with two types of triple-layered segments in accordance with a second embodiment of the present invention;

FIG. 7 is a view showing an arrangement of segments of a diamond tool in accordance with a third embodiment of the present invention;

FIG. 8 is a view showing an arrangement of diamonds set on a segment of a diamond tool in accordance with a fourth embodiment of the present invention; and FIG. 9 is a view showing an arrangement and cutting pattern of leading and trailing segments of a diamond tool in accordance with a fifth embodiment of the present invention;

DETAILED DESCRIPTION OF THE INVENTION

Figure 1:
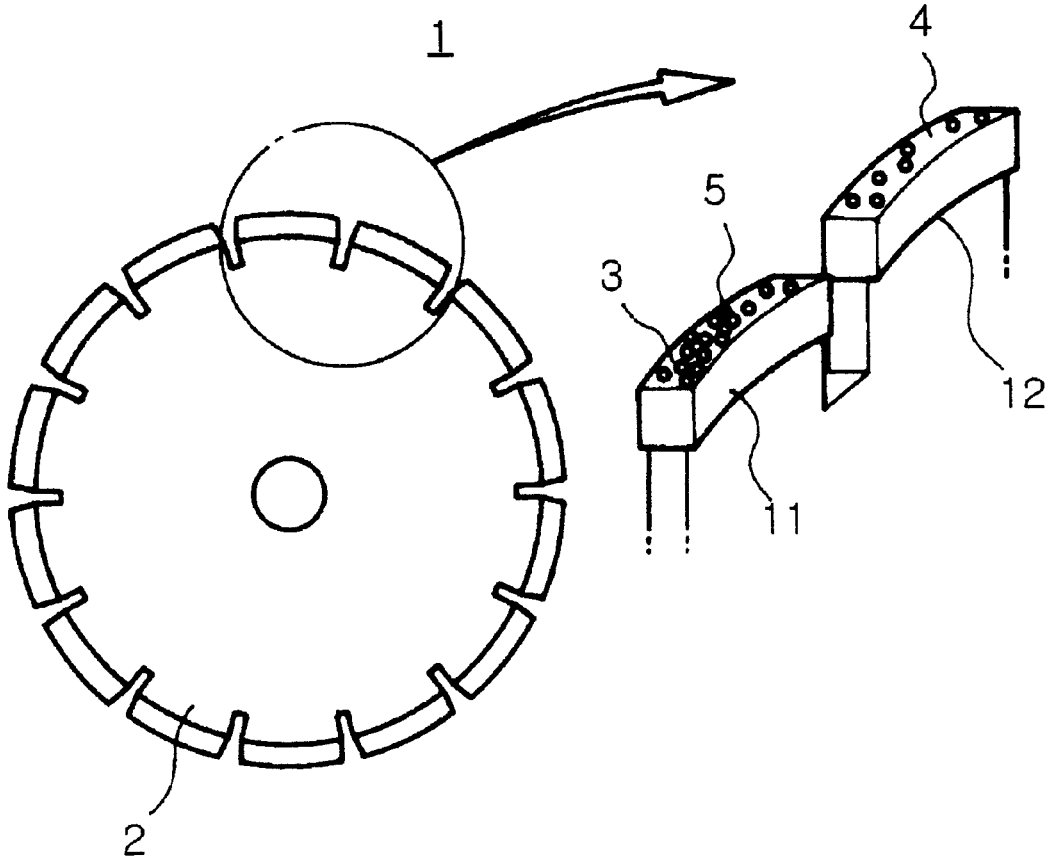
PRIOR ART FIG. 1
FIG. 1 is a view of a conventional diamond tool randomly set with diamonds on each segment thereof.

Reference now should be made to the drawings, in which the same reference numerals are used throughout the different drawings to designate the same or similar components.

The object of the present invention is to appropriately arrange diamonds on the cutting surface of each segment of a diamond tool such that the diamonds more effectively cut the surface of a brittle substance in a cutting process.

The conventional diamond tool randomly set with diamonds on its segments is shown in FIG. 1. This diamond tool may form three types of cut patterns on the surface of the brittle substance as follows. First, the diamonds of a trailing segment may pass along the grooves previously formed on the surface of the brittle substance by the diamonds of a leading segment, and so the diamonds of the trailing segment do not perform any work. Second, the diamonds of a trailing segment may pass along the lands between grooves previously formed on the surface of the brittle substance by the diamonds of a leading segment, thus completely removing the lands from the surface of the brittle substance. Third, the lands between grooves formed on the surface of the brittle substance by the diamonds of a leading segment may be remarkably wide such that it is almost impossible to completely remove the lands from the surface of the brittle substance even when the diamonds of a trailing segment pass along the lands.

The present invention reduces the occurrence of the first and third cutting patterns by appropriately arranging the diamonds on the segments, but allows the diamond tool to effectively cut the surface of a brittle substance by the second cutting pattern, thus maximizing the cutting rate of the diamond tool.

That is, the diamond tool of this invention is produced by setting the diamonds on the segments such that the diamonds of a trailing segment pass along the lands between grooves previously formed on the surface of a brittle substance by the diamonds of a leading segment, thus completely removing the lands from the surface of the brittle substance.

Such an arrangement of the diamonds on the segments accomplishes an effective cutting operation, and increases the cutting rate of the diamond tool. In addition, the diamond tool of this invention cuts a brittle substance while generating large debris particles. This diamond tool thus reduces the amount of fine debris generated during a cutting process, thereby protecting workers from the fine debris.

Preferred arrangements of the diamonds on the segments according to the present invention will be described herein below.

A segment type diamond tool according to a preferred embodiment of this invention comprises a plurality of segments each set with diamonds, and a steel core holding the segments thereon.

In each segment of the diamond tool, the diamonds are arranged in one or more layers parallel to the side surface of the steel core such that the diamonds form one or more diamond lines on the cutting surface of the segment. The diamonds are also set within the layers of each segment to form a plurality of diamond lines parallel to the cutting surface of the segment.

In a diamond tool according to an embodiment of this invention, the diamonds of a leading segment are set in an n-layered structure, while the diamonds of a trailing segment are set in an n'-layered structure. In such a case, $n' \leqq n$. In the above diamond tool, a plurality of leading segments and a plurality of trailing segments are alternately arranged on the steel core. The two types of segments are designed such that the diamond layers of each trailing segment are aligned with the gaps of the diamond layers of each leading segment.

In another embodiment of this invention, each segment of the diamond tool may be divided into two sections, that is, a leading section and a trailing section, with the diamonds of the leading section being arranged in an n-layered structure, and the diamonds of the trailing section being arranged in an n'-layered structure. In such a case, $n' \leqq n$. In the above diamond tool, the leading and trailing sections of each segment are designed such that the diamond layers of the trailing section are aligned with the gaps of the diamond layers of the leading section.

In a preferred embodiment of this invention, a plurality of segments each set with diamonds in an n-layered structure and a plurality of segments each set with diamonds in an (n−1)-layered structure are alternately arranged on a diamond tool.

In the above embodiment, the two types of segments are arranged such that the diamond layers of the (n−1)-layered structure are aligned with the gaps of the diamond layers of the n-layered structure.

Figure 2:
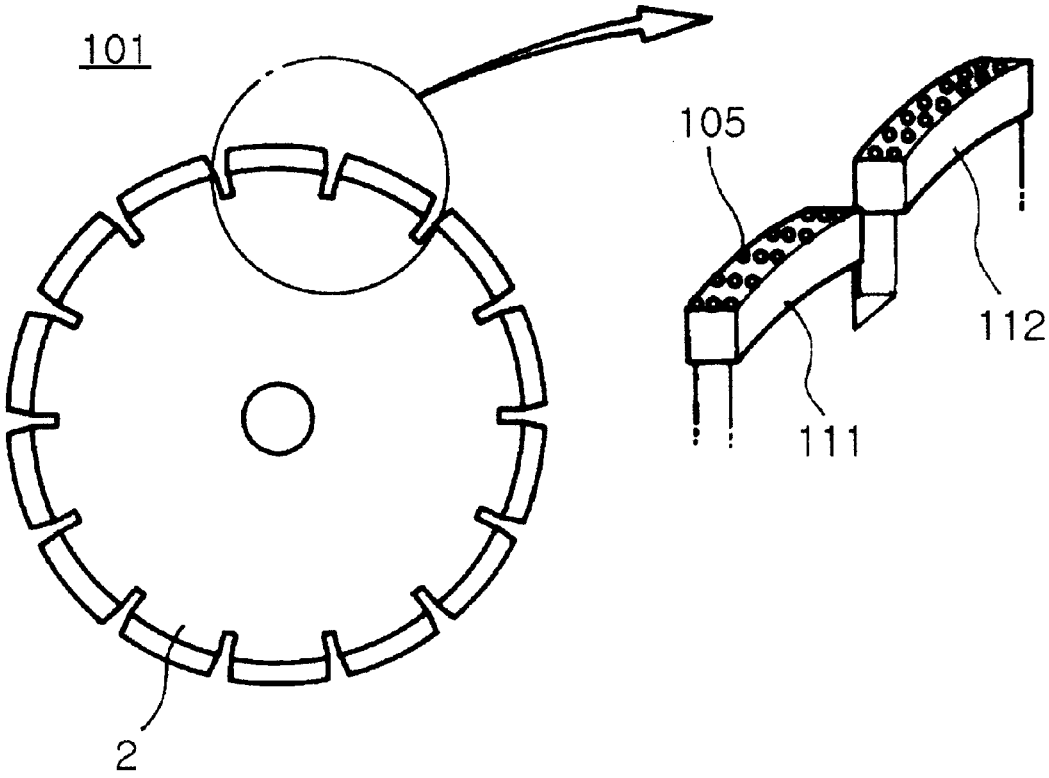
FIG. 2 is a view of a diamond tool in accordance with the primary embodiment of the present invention, provided with triple-layered segments each set with diamonds in three layers and double-layered segments each set with diamonds in two layers, the two types of segments being alternately arranged along the outer edge of a steel core.

FIG. 2 is a view of a diamond tool in accordance with the primary embodiment of the present invention, provided with two types of segments having different diamond arrangements. The diamond tool of FIG. 2 is a diamond saw blade.

As shown in FIG. 2, the diamond tool 101 comprises a plurality of two types of segments 111 and 112 each set with diamonds, and a steel core 2 holding the segments 111 and 112 thereon. In this diamond tool 101, the leading segments 111 are triple-layered segments each set with diamonds 105 in a triple-layered structure, while the trailing segments 112 are double-layered segments each set with diamonds 105 in a double-layered structure.

In such a case, the diamonds 105 are specifically arranged on the two types of segments such that the diamond layers of each double-layered segment are aligned with the gaps of the diamond layers of each triple-layered segment.

In the second embodiment of this invention, a plurality of segments each set with diamonds in an n-layered structure are arranged on a diamond tool such that the diamond layers of each segment are aligned with the gaps of the diamond layers of a neighboring segment.

Figure 6:
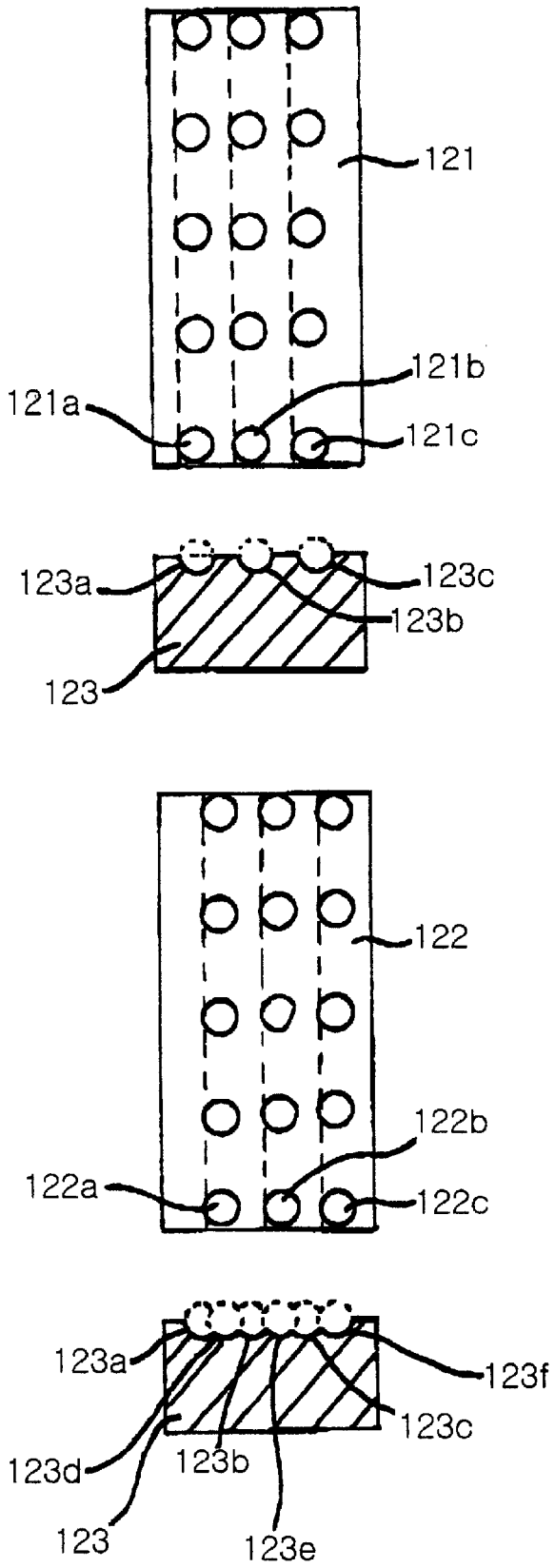

This second embodiment is shown in FIG. 6.

As shown in FIG. 6, each leading segment 121 is set with diamonds along three layers 121*a*, 121*b* and 121*c*, while each trailing segment 122 is set with diamonds along three layers 122*a*, 122*b* and 122*c*. In such a case, the leading segments 121 and the trailing segments 122 are arranged such that the three diamond layers 121*a*, 121*b* and 121*c* of each leading segment are aligned with the gaps between the three diamond layers 122*a*, 122*b* and 122*c* of each trailing segment.

In the third embodiment of this invention, a segment set with diamonds in an n-layered structure and two or more segments each set with diamonds in an (n−2)- or less-layered structure are repeatedly arranged on a diamond tool.

In the diamond tool, the segments are arranged such that the diamond layers of the segments each set with diamonds in the (n−2)- or less-layered structure are aligned with the gaps of the diamond layers of the segment set with diamonds in the n-layered structure.

Figure 7:
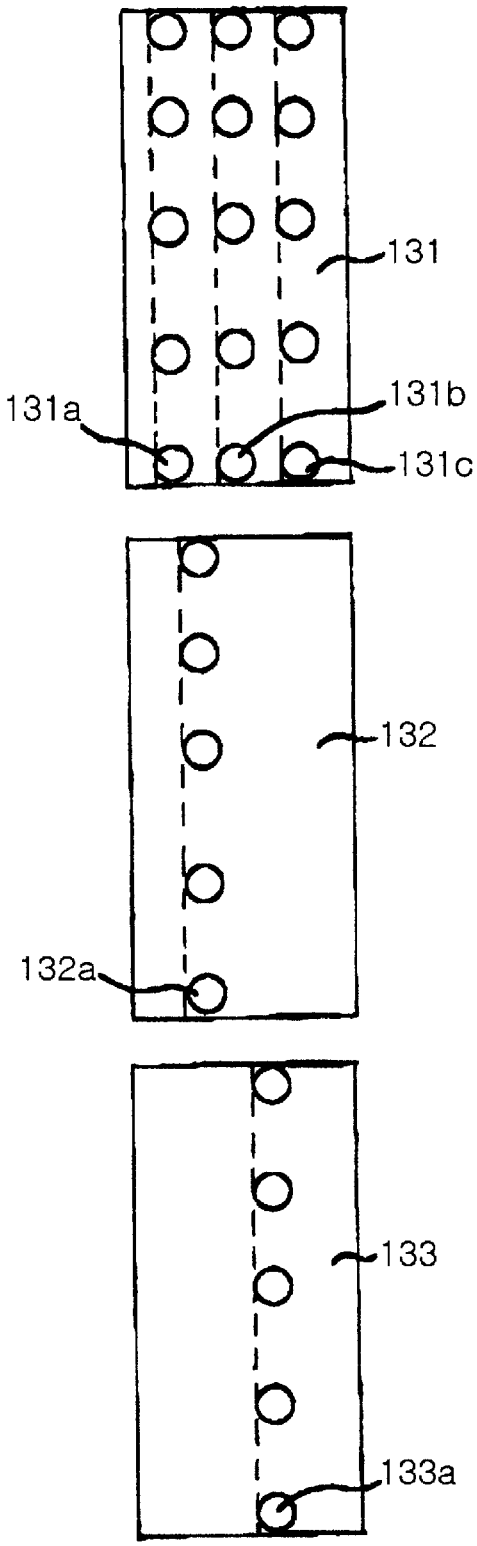

This third embodiment is shown in FIG. 7.

As shown in FIG. 7, a plurality of segments are arranged on the diamond tool such that the diamond layers 132*a* and 133*a* of two segments 132 and 133 each set with diamonds in a single-layered structure are aligned with the gaps of the diamond layers 131*a*, 131*b* and 131*c* of the segment 131 set with diamonds in a triple-layered structure.

Figure 8:
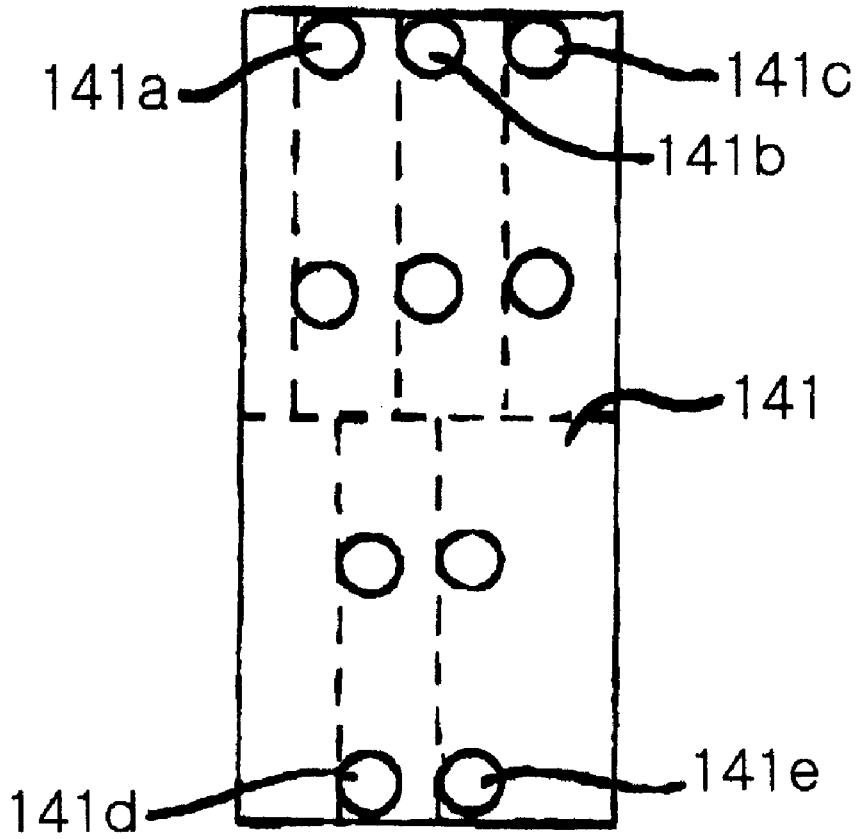

A diamond tool according to the fourth embodiment of this invention is shown in FIG. 8. In this diamond tool, each segment 141 is divided into two sections, that is, a leading section and a trailing section, with the diamonds of the leading section being arranged in a triple-layered structure, and the diamonds of the trailing section being arranged in a double-layered structure.

As shown in FIG. 8, the two diamond layers 141*d* and 141*e* of the trailing section are aligned with the gaps of the three diamond layers 141*a*, 141*b* and 141*c* of the leading section.

In the present invention, the diamonds are irregularly set in a part of the diamond layers of each segment or all the diamond layers of each segment to allow the diamond layers to appear as bands on the cutting surface of the segment.

Figure 9:
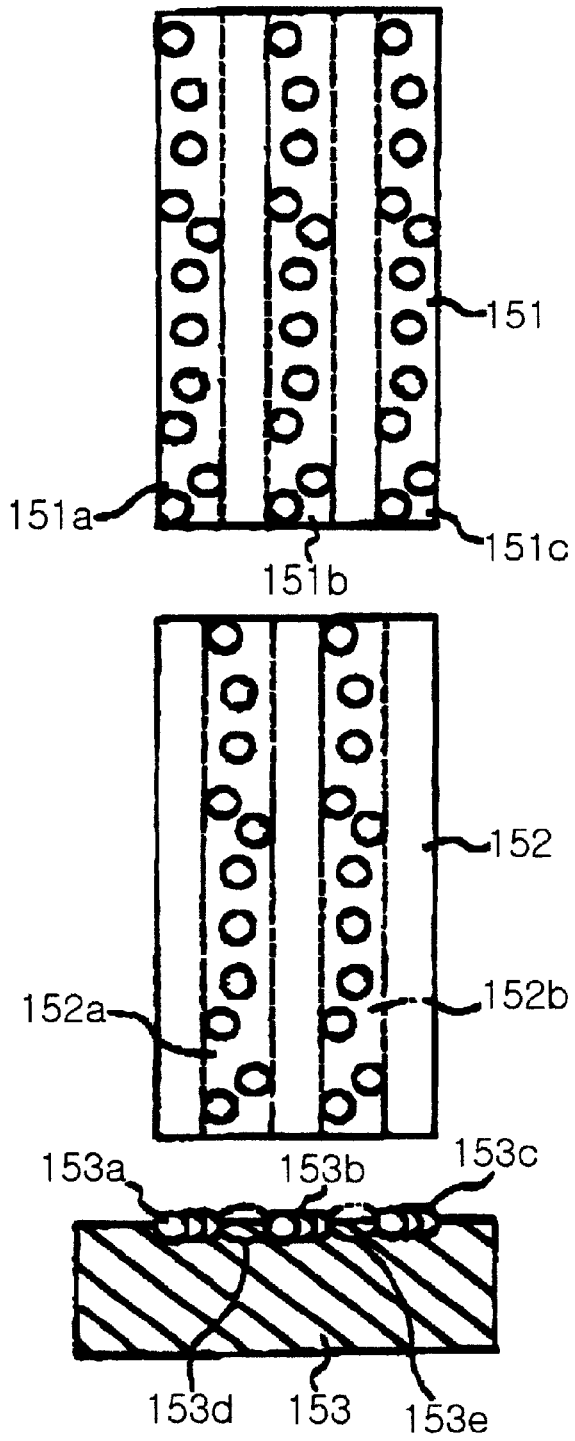

FIG. 9 shows a diamond tool designed such that the diamonds are irregularly set in all the diamond layers of each segment to allow the diamond layers to appear as bands on the cutting surface of the segment according to the fifth embodiment of this invention.

As shown in FIG. 9, each leading segment 151 of the diamond tool is set with diamonds in three layers 151*a*, 151*b* and 151*c* appearing as bands on the cutting surface of the segment 151, while each trailing segment 152 is set with diamonds in two layers 152*a* and 152*b* appearing as bands on the cutting surface of the segment 152. During a cutting process using this cutting tool, the three diamond layers 151*a*, 151*b* and 151*c* of the leading segment 151 form three grooves 153*a*, 153*b* and 153*c* on the surface of a brittle substance 153, while the two diamond layers 152*a* and 152*b* of the trailing segment 152 form two grooves 153*d* and 153*e* along the lands between the three previously formed grooves 153*a*, 153*b* and 153*c*. Therefore, the diamond tool of this embodiment effectively cuts the surface of the brittle substance 153.

Figure 10:
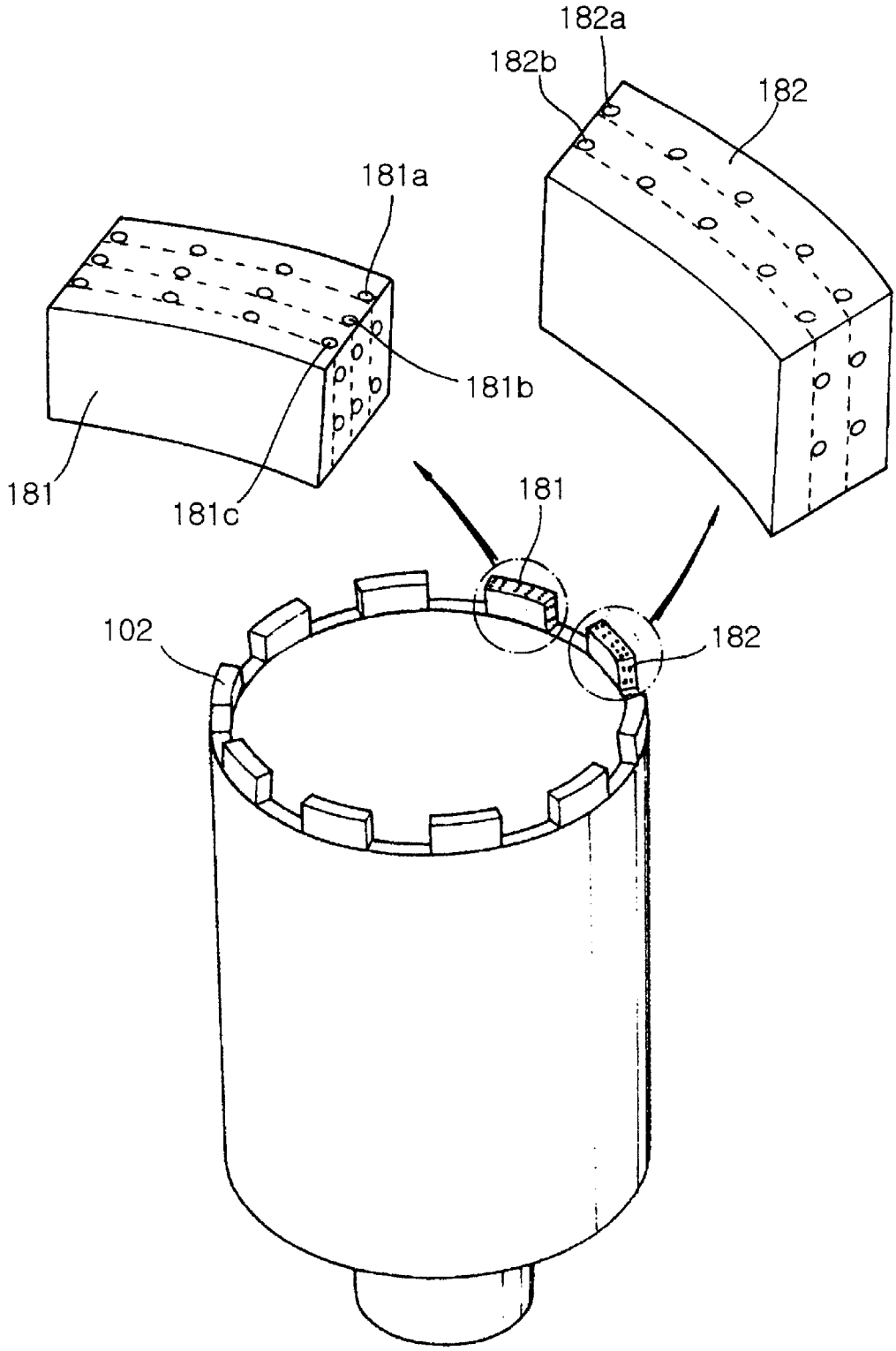
FIG. 10 is a view showing segments of a diamond tool in accordance with a sixth embodiment of the present invention.

The present invention may be adapted to another type diamond tool, a so-called "core bit", consisting of a plurality of segments as shown in FIG. 10.

FIG. 10 is a view showing a core bit having a plurality of segments designed in accordance with the sixth embodiment of the present invention. As shown in the drawing, the segments 102 of the core bit are arranged such that a plurality of leading segments 181 each set with diamonds in three layers 181*a*, 181*b* and 181*c* and a plurality of trailing segments 182 each set with diamonds in two layers 182*a* and 182*b* are alternately arranged.

In the present invention, the segment arrangement of the diamond tool may be designed such that one or more random segments each set with randomly distributed diamonds are arranged between the layered segments each set with diamonds in a single- or multi-layered structure.

For example, the segments of the diamond tool may be arranged in a (triple-layered segment+double-layered segment+random segment) arrangement, a (triple-layered segment+random segment+double-layered segment) arrangement, a (triple-layered segment+random segment+double-layered segment+random segment) arrangement, or a (triple-layered segment+double-layered segment+random segment+random segment) arrangement.

A diamond tool according to this invention provided with such a random segment is increased in its cutting rate in comparison with conventional diamond tools. However, the cutting rate of this diamond tool is lower than that of other diamond tools not having such a random segment.

In the diamond tool of the present invention, each of the gaps between the diamond layers of each leading segment is preferably designed to be less in width than or equal to the thickness of each diamond layer of each trailing segment.

In addition, the diamond layers of each segment of the diamond tool are preferably designed such that effective diamond lines are always exposed on the cutting surface of the segment, regardless of continuous abrasion of the cutting surface.

Figure 11:
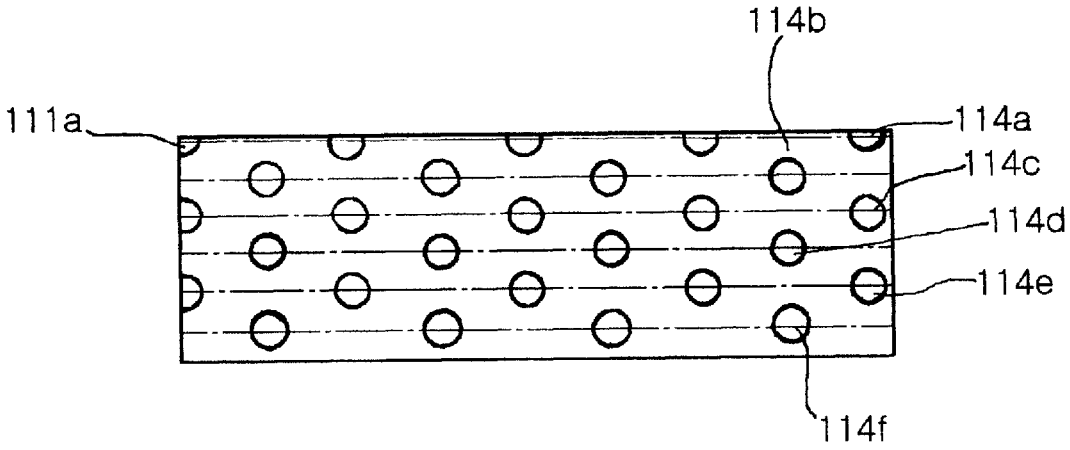
FIG. 11 is a sectional view taken along the line A—A of FIG. 3.

As shown in FIG. 11, in order to accomplish the above object, it is preferred to form the diamond layers 111*a*, 111*b* and 111*c* of each segment such that the diamond lines 114*a*, 114*b*, 114*c*, 114*d*, 114*e* and 114*f* in each of the diamond layers 111*a*, 111*b* and 111*c* are set with diamonds with no gap left between said diamond lines 114*a*, 114*b*, 114*c*, 114*d*, 114*e*, and 114*f* each parallel to the cutting surface of the segment.

When the diamond lines are arranged as described above, effective diamond lines are always exposed on the cutting surface of the segment, regardless of continuous abrasion of the cutting surface.

In the present invention, the diamonds may be only set in the central portion of a segment. In such a case, the two outer side portions of the segment are not set with diamonds, and so the metal powder of the segment may be quickly abraded at the outer side portions to allow an undesirable early separation of the diamonds from the segment. Such a separation of diamonds from the segment is known as a "pop-out" in the diamond tool industrial field.

In order to prevent such an undesirable early pop-out of the diamonds from a segment, a filler having a high abrasion resistance is preferably added to the diamond-free outer side portions of the segment.

That is, in order to increase the wear performance of the diamond tool of this invention, a filler, which is an abrasive material of high hardness, is preferably added to the metal powder, thus increasing the abrasion resistance of the metal powder. In the present invention, the filler is selected from abrasive powder, such as SiC, WC, BN, $Al_2O_3$, diamond, or mixtures thereof.

As described above, the filler is added to the metal powder forming the two outer side portions of a segment in an effort to prevent an undesirable early pop-out of diamonds from the segment. When diamond is used as the filler, the concentration of the diamond used as the filler must be lower than that of the diamonds set in the central portion of the segment used for cutting a brittle substance.

In the present invention, it is preferred to set the concentration of the diamond used as the filler to 10~60% of the concentration of the diamonds set in the central portion of the segment used for cutting.

When the concentration of the diamond used as the filler is less than 10% of the concentration of the diamonds set in the central portion of the segment used for cutting, it is almost impossible to prevent the outer side portions of the segment from being quickly abraded. On the other hand, when the concentration of the diamond used as the filler is higher than 60% of the concentration of the diamonds set in the central portion of the segment used for cutting, the amount of cutting diamonds is reduced decreasing the cutting rate of a resulting diamond tool.

Figure 12:
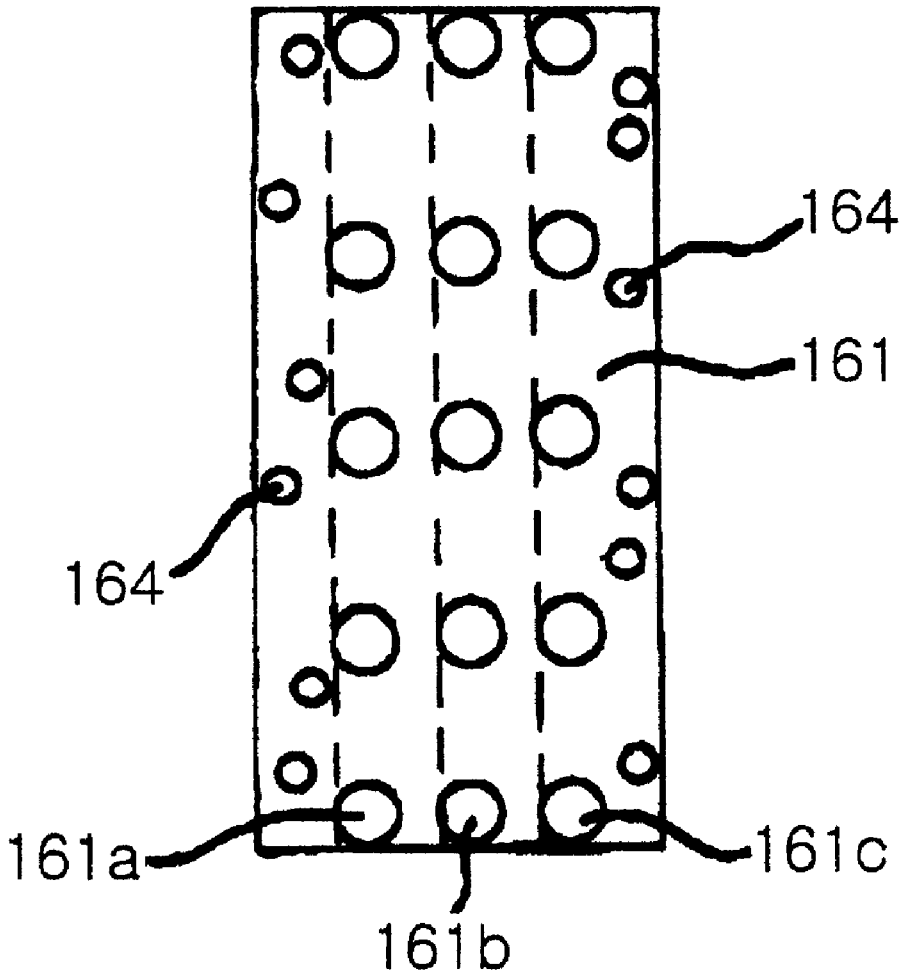
FIG. 12 is a view of a segment for diamond tools, randomly set with fillers on its outer side portions in accordance with a seventh embodiment of the present invention.

In the present invention, the filler 164 may be randomly distributed on the outer side portions of a segment 161 as shown in FIG. 12. Alternatively, the filler 174 may be regularly distributed on the outer side portions of a segment 171 as shown in FIG. 13.

Figure 13:
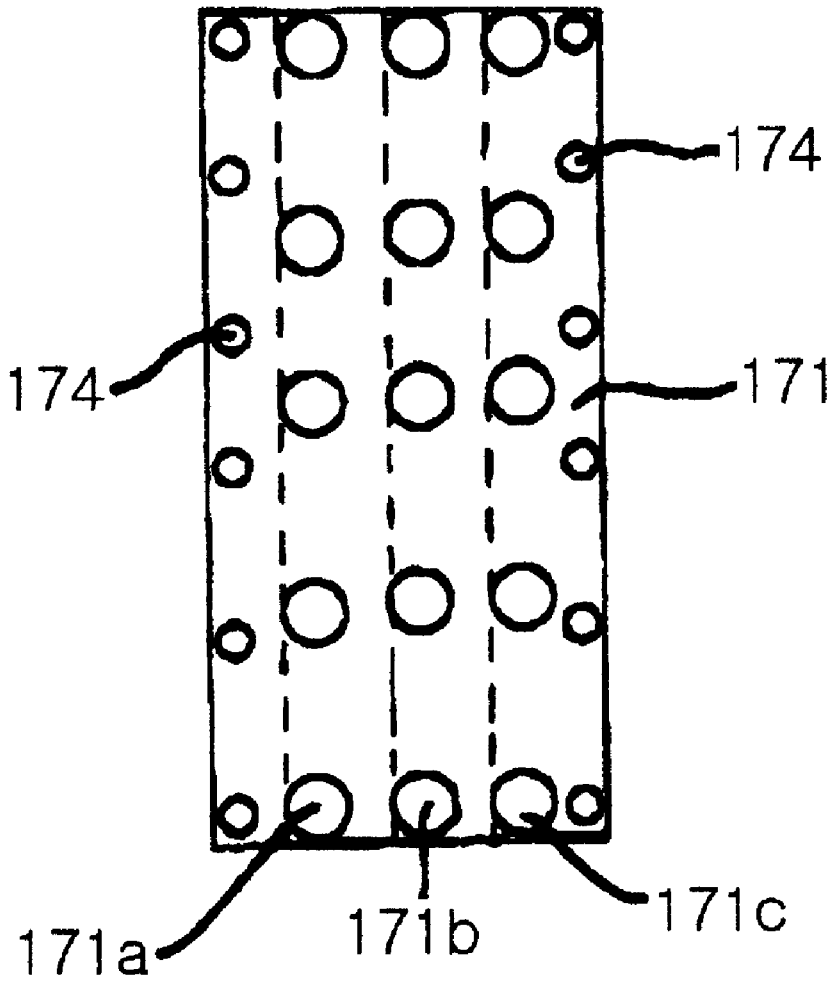
FIG. 13 is a view of a segment for diamond tools, regularly set with fillers on its outer side portions in accordance with an eighth embodiment of the present invention.

In FIGS. 12 and 13, the reference numerals 161*a*, 161*b*, 161*c*, 171*a*, 171*b* and 171*c* denote diamond layers formed in the segments 161 and 171.

The diamond tool of the present invention may be produced as follows:

A bonding agent is primarily sprayed on a metal net cut in the form of a desired segment. Thereafter, a metal jig, having a plurality of regularly spaced and laser-processed holes, is laid on the metal net prior to application of the diamonds to the jig. In such a case, one diamond is set in each of the laser-processed holes of the jig. When the metal jig is removed from the metal net, the diamonds are left on the metal net while being regularly arranged on said net. The diamonds along with metal powder are sequentially subjected to a cold forming process and a sintering process, thus producing a desired segment for diamond tools of this invention.

The above-mentioned process of producing the diamond tool is an example, but is not to be construed as the limit of the present invention.

The cutting patterns obtained by the diamond tool of this invention when cutting the surface of a brittle substance using the tool will be described herein below.

FIG. 2 shows a diamond saw blade, which is an example of diamond tools according to the present invention.

In the diamond saw blade 101 of FIG. 2, two types of segments 111 and 112 are alternately arranged. Of the two types of segments, the segments 111 are triple-layered segments each set with diamonds 105 in three layers, while the segments 112 are double-layered segments each set with diamonds 105 in two layers.

Figure 3:
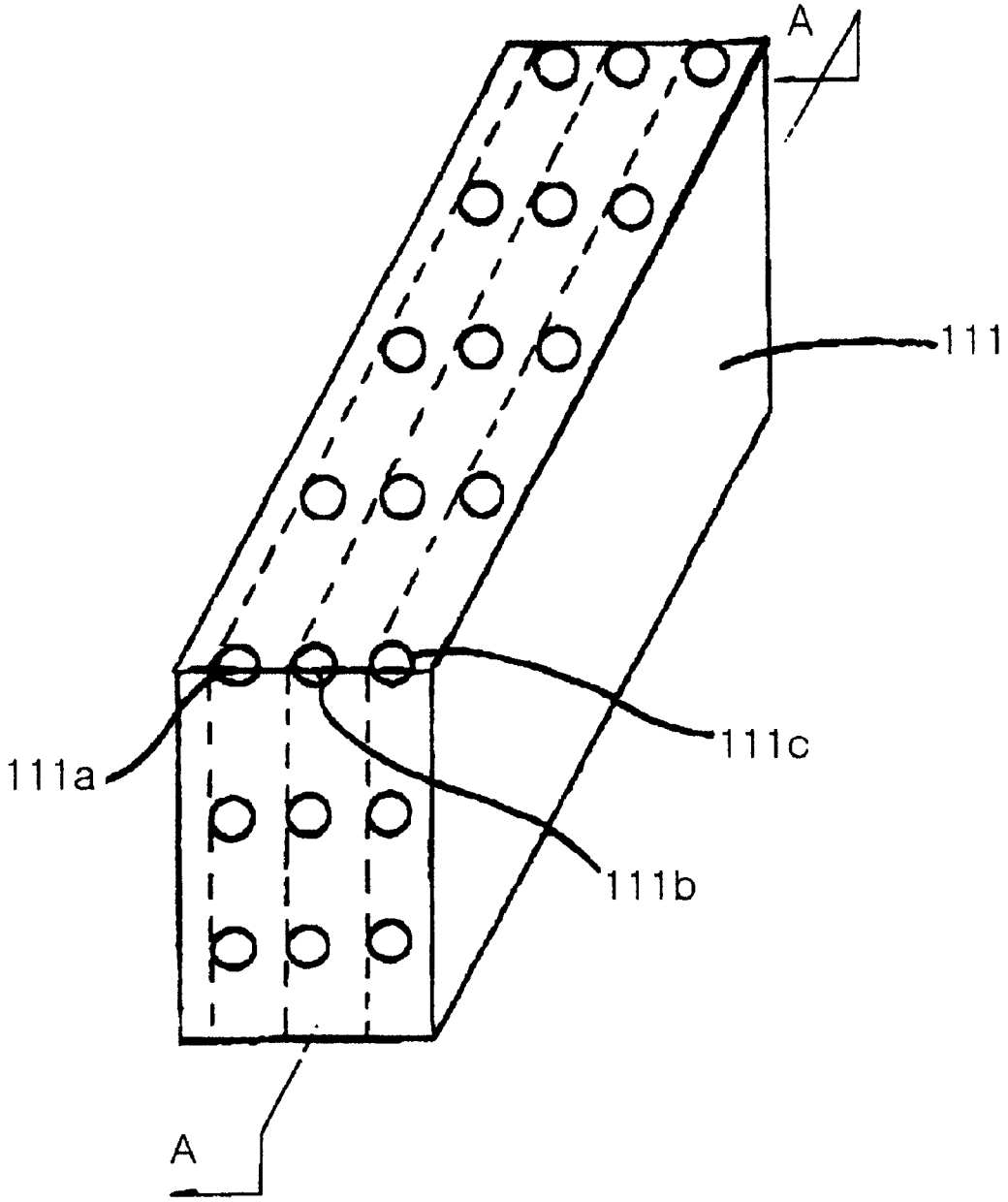
FIG. 3 is a view showing the construction of one of the triple-layered segments included in the diamond tool of this invention.
Figure 4:
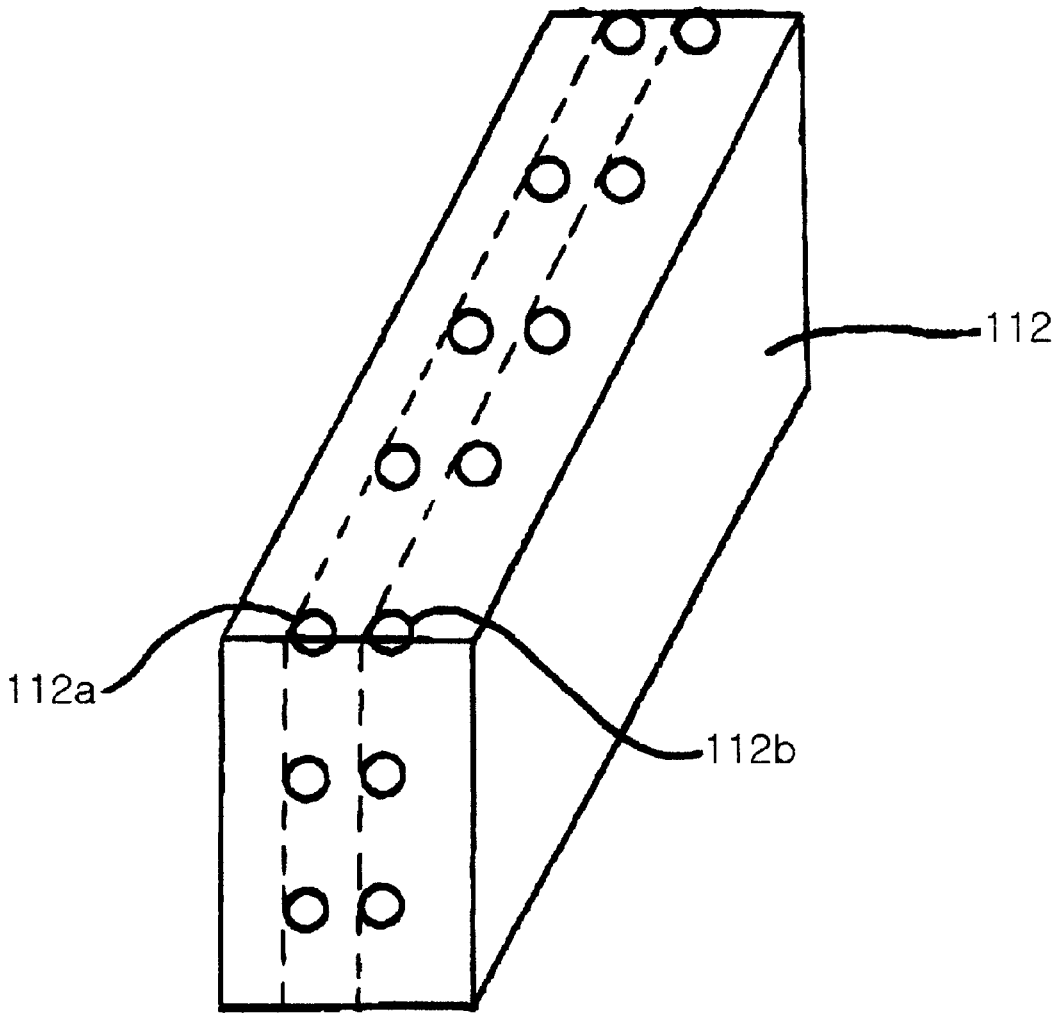
FIG. 4 is a view showing the construction of one of the double-layered segments included in the diamond tool of this invention.

FIG. 3 shows a triple-layered segment 111 set with diamonds in its three layers 111*a*, 111*b* and 111*c*. FIG. 4 shows a double-layered segment 112 set with diamonds in its two layers 112*a* and 112*b*.

Figure 5:
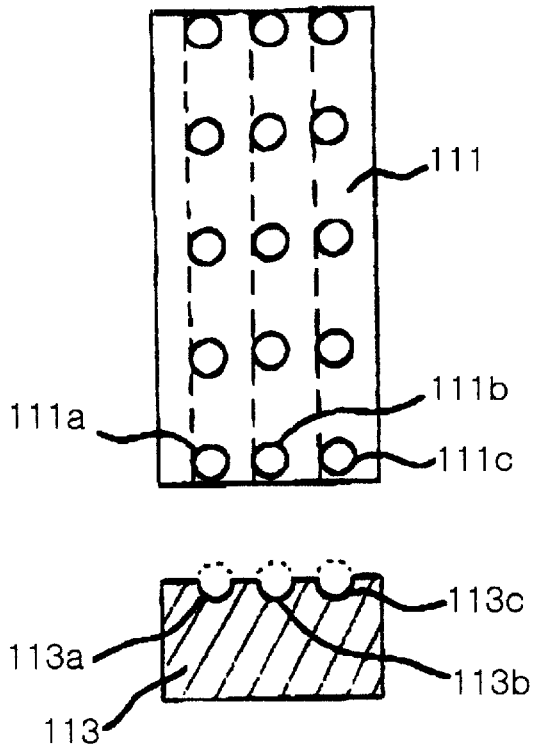
Figure 5:
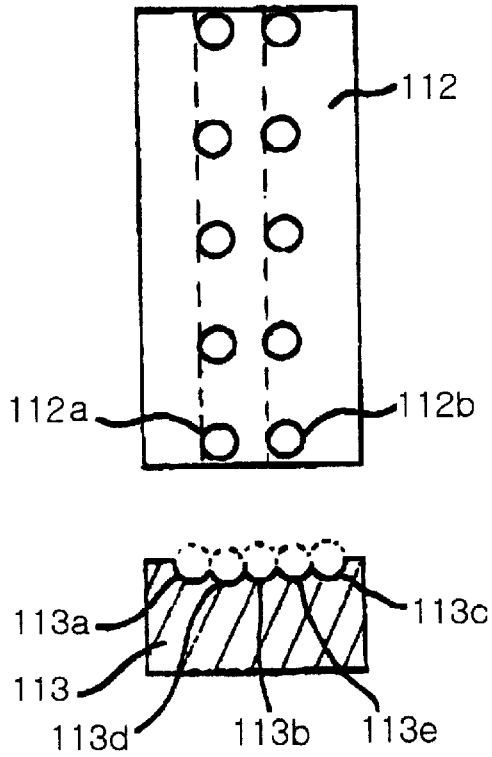

As shown in FIGS. 3, 4 and 5, a plurality of triple-layered segments 111, each set with diamonds in three layers 111*a*, 111*b* and 111*c*, and a plurality of double-layered segments 112 each set with diamonds in two layers 112*a* and 112*b* are alternately arranged along the edge of a steel core 2, thus forming a desired diamond saw blade 101. When cutting the surface of a brittle substance 113 using the saw blade 101, the diamonds of the double-layered segments 112 form grooves 113*d* and 113*e* on the lands between grooves 113*a*, 113*b* and 113*c* previously formed on the brittle substance 113 by the diamonds of the triple-layered segment 111, thus effectively cutting the surface of the brittle substance 113.

That is, the diamonds of the two types of segments 111 and 112 continuously cut the surface of the brittle substance 113 as best seen in FIG. 5, thus more effectively cutting the surface of the brittle substance to a desired depth while increasing the cutting rate of the diamond tool. This also allows the diamond tool to cut the brittle substance while generating large debris particles. The diamond tool thus reduces the amount of fine debris generated from a cutting process, and protects workers from the fine debris.

FIG. 6 shows a cutting pattern obtained from a cutting process using a diamond tool, having a plurality of segments each set with diamonds in three layers and arranged on the tool such that the diamond layers of each segment are aligned with the gaps of the diamond layers of a neighboring segment. During a cutting process, the three diamond layers 121*a*, 121*b* and 121*c* of a leading segment 121 form grooves 123*a*, 123*b* and 123*c* on the surface of a brittle substance 123, while the three diamond layers 122*a*, 122*b* and 122*c* of a trailing segment 122 form grooves 123*d*, 123*e* and 123*f* along the lands between the grooves 123*a*, 123*b* and 123*c*. Therefore, the diamonds of the segments 121 and 122 continuously cut the surface of the brittle substance 123, thus effectively cutting the surface of the brittle substance 123 while increasing the cutting rate of the diamond tool. This also allows the diamond tool to cut the brittle substance while generating large debris particles, and so the amount of fine debris generated from a cutting process is preferably reduced.

In the diamond tool of the present invention, the diamonds may be somewhat irregularly set in each diamond layer of each segment to allow the diamond layer to appear as a band on the cutting surface of the segment.

FIG. 9 shows a cutting pattern obtained from a cutting process using a diamond tool, which has alternately arranged leading and trailing segments, with each leading segment designed such that the diamonds are irregularly set in three diamond layers appearing as bands on the cutting surface of the leading segment and each trailing segment designed such that the diamonds are irregularly set in two diamond layers appearing as bands on the cutting surface of the trailing segment. During a cutting process, the three diamond layers 151*a*, 151*b* and 151*c* of a leading segment 151 form grooves 153*a*, 153*b* and 153*c* on the surface of a brittle substance 153, while the two diamond layers 152*a* and 152*b* of a trailing segment 152 form grooves 153*d* and 153*e* along the lands between the grooves 153*a*, 153*b* and 153*c*. Therefore, the diamonds of the segments 151 and 152 continuously cut the surface of the brittle substance 153, thus effectively cutting the surface of the substance 153 while increasing the cutting rate of the diamond tool.

A better understanding of the present invention may be obtained through the following examples which are set forth to illustrate, but are not to be construed as the limit of the present invention.

EXAMPLE 1

Three diamond tools in the form of saw blades were produced and subjected to a cutting test to measure the cutting rate and wear performance of the diamond tools. The results are given in Table 1. The first diamond tool of Example 1-1 was formed to have an alternate arrangement of triple-layered segments each regularly set with diamonds in three layers and double-layered segments each regularly set with diamonds in two layers (segment arrangement: 3×2). The second diamond tool of Example 1-2 was formed to have an alternate arrangement of quadruple-layered segments each regularly set with diamonds in four layers and triple-layered segments each regularly set with diamonds in three layers (segment arrangement 4×3). The third diamond tool of Comparative Example 1 was formed to have an arrangement of segments each randomly set with diamonds (segment arrangement: random).

In each segment of Examples 1-1 and 1-2, the thickness of each diamond layer was set to 0.4 mm equal to the average diamond mesh size. The gaps between the diamond layers of the segments of Example 1-1 were set to 0.3 mm wide, while the gaps between the diamond layers of the segments of Example 1-2 were set in width to 0.16 mm.

In the three diamond tools, an Fe—Ni based alloy was used as a metal powder, and diamonds of MBS 955 manufactured by GE Company Ltd. of the USA were used. The sintering was processed through a hot press process at 950° C. for 5 minutes.

In each of the three diamond tools, sixteen segments were welded to a 9" diameter steel core through a laser welding process. In the cutting test, each diamond tool cut granite to a depth of 20 mm.

The cutting test was performed with a 9" grinder manufactured by Bosch Company Ltd. and operated at 6,500 rpm.

The segments of each diamond tool each had a length of 38 mm, a height of 7.2 mm and a thickness of 2.4 mm.

TABLE 1

| Example No. | Segment arrangement | Concentration (cts/cc) | Cutting rate (▲/min) | Cutting rate (%) | Wear performance (▲/◀) | Wear performance (%) |
|---|---|---|---|---|---|---|
| Ex. 1-1 | 3 × 2 | 0.6 | 480.8 | 132 | 3.132 | 120 |
| Ex. 1-2 | 4 × 3 | 0.6 | 469.8 | 129 | 2.920 | 112 |
| Com. Ex. 1 | random | 0.6 | 364.2 | 100 | 2.606 | 100 |

In Table 1, Ex. stands for Example, and Com. Ex. stands for Comparative Example

From Table 1, it is apparent that the diamond tools of Example 1-1 and Example 1-2 designed in accordance with the present invention are remarkably improved in their cutting rate and wear performance in comparison with the diamond tool of Comparative Example 1 designed in accordance with the prior art.

Such an improvement in the cutting rate and wear performance of the diamond tools designed according to the present invention is caused by the diamond arrangement allowing all of the diamonds set in the segments to effectively perform their cutting action.

EXAMPLE 2

The diamond tool of Example 1-1 and the diamond tool of Comparative Example 1 were tested to measure the variation in cutting time (sec) as a function of the number of cutting cycles. The results are given in the graph of FIG. 14.

In such a case, the cutting time is the time consumed by a diamond tool to completely cut a brittle substance once. The cutting cycle is an operation wherein the diamond tool completely cuts a brittle substance having a length of 30 cm once with a constant depth.

Figure 14:
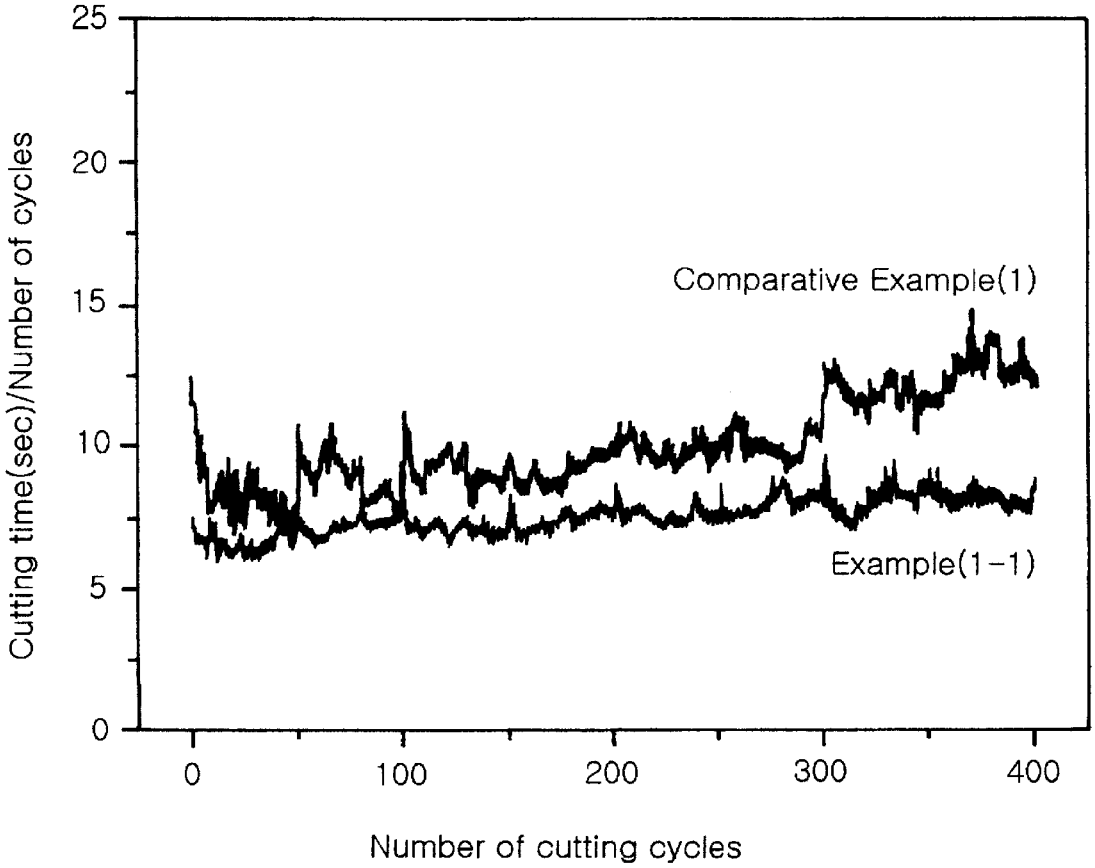
FIG. 14 is a graph showing a cutting time of the diamond tool of this invention as a function of the number of cutting cycles, in comparison with a conventional diamond tool.

As shown in the Graph of FIG. 14, the diamond tool of Example 1-1 according to this invention is reduced in its cutting time (sec) in comparison with the conventional diamond tool of Comparative Example 1. The diamond tool of Example 1-1 also shows only a slight variation in its cutting time with continuous use, and has a uniform operational performance.

EXAMPLE 3

Two diamond tools in the form of 14" diameter saw blades were produced and subjected to a cutting test to measure the cutting rate and wear performance of the diamond tools. The results are given in Table 2. The first diamond tool of Example 3 was formed to have an alternate arrangement of triple-layered segments each irregularly set with diamonds in three layers appearing as bands on the cutting surface of each segment and double-layered segments each irregularly set with diamonds in two layers appearing as bands on the cutting surface of each segment (segment arrangement: 3×2). The second diamond tool of Comparative Example 2 was formed to have an arrangement of segments each randomly set with diamonds (segment arrangement: random).

The segments of each diamond tool each had a length of 40 mm, a height of 7.2 mm and a thickness of 3.2 mm. An Fe—Ni based alloy was used as a metal powder, and diamonds of MBS 955 manufactured by GE Company Ltd. of the USA were used. The sintering was processed through a hot press process at 950° C. for 5 minutes.

In each of the two diamond tools, segments were welded to a 14" diameter steel core through a laser welding process. In the cutting test, each diamond tool cut a concrete structure to a depth of 35 mm. The cutting test was performed with an engine-operated cutting tester of 5.5 HP manufactured by EDCO Company Ltd.

In the diamond tool of Example 3, the thickness of each diamond layer was set to 0.8 mm, and the gaps between the diamond layers were set to 0.4 mm wide.

In the diamond tool of Example 3, the same diamonds as those of the diamond layers were added to the two outer side portions of each double-layered segment in an effort to prevent quick abrasion of said outer side portions. That is, diamonds were used as a filler in the outer side portions of each double-layered segment. In such a case, the concentration of the diamonds used as the filler was set to 25% of that of the diamonds set in the diamond layers of each segment used for cutting.

TABLE 2

| Example No. | Segment arrangement | Concentration (cts/cc) | Cutting rate (▲/min) | Cutting rate (%) | Wear performance (▲/◀) | Wear performance (%) |
|---|---|---|---|---|---|---|
| Ex. 3 | 3 × 2 | 0.8 | 558.8 | 120 | 3.828 | 105 |
| Com. Ex 2 | Random | 0.8 | 465.7 | 100 | 3.646 | 100 |

In Table 2, Ex. stands for Example, and Com. Ex. stands for Comparative Example

From Table 2, it is apparent that the diamond tool of Example 3, designed according to the present invention, has remarkably increased cutting rate and remarkably improved wear performance in comparison with the diamond tool of Comparative Example 2 designed in accordance with the prior art.

EXAMPLE 4

In order to prevent quick abrasion of two outer side portions of each segment, the segments of the diamond tools similar to that of Example 1-1 with an alternate arrangement of triple-layered segments each regularly set with diamonds in three layers and double-layered segments each regularly set with diamonds in two layers (segment arrangement: 3×2) were produced using a filler added to a metal powder. The resulting diamond tools were subjected to a cutting test to measure abrasion of the segments. The results are given in Table 3.

In each of the diamond tools, the same diamonds as those of the diamond layers were added as a filler to the outer side portions of each segment. In such a case, the concentration of the diamonds used as the filler was set to 5~70% of that of the diamonds set in the diamond layers of each segment used for cutting.

The abrasion of outer side portions of the segments of each diamond tool was measured by a reduction in thickness of the segments after a cutting process.

In such a case, the reduction in thickness of the segments of each diamond tool was measured by a reduced thickness removed from the original segment's thickness of 2.4 mm after a process of cutting 30 m and 60 m of a brittle substance.

The reduction in thickness of the segments of each diamond tool was obtained by measuring the reductions in thickness of four segments, angularly spaced apart from a randomly selected segment at an angle of 90°, prior to averaging the measured thickness reductions. The other cutting conditions were kept the same as those of Example 1.

TABLE 3

| Example No. | Filler concentration (%) | Segment thickness reduction (mm) 30 m cutting | 60 m cutting | Evaluation |
|---|---|---|---|---|
| Com. Ex. 3 | 5 | 0.17 | 0.33 | Low abrasion resistance |
| Ex. 4-1 | 10 | 0.08 | 0.11 | Good |
| Ex. 4-2 | 30 | 0.05 | 0.08 | Good |
| Ex. 4-3 | 40 | 0.03 | 0.07 | Good |
| Ex. 4-4 | 50 | 0.03 | 0.04 | Good |
| Ex. 4-5 | 60 | 0.02 | 0.03 | Good |
| Com. Ex. 4 | 70 | 0.02 | 0.04 | Low cutting rate |

In Table 3, Ex. stands for Example, and Com. Ex. stands for Comparative Example

From table 3, it is noted that the segments of the diamond tool of Comparative Example 3 laden with the filler of an excessively low concentration were quickly abraded to be greatly reduced in thickness. However, the segments of each of the diamond tools of Exs. 4-1, 4-2, 4-3, 4-4 and 4-5 designed according to the present invention were very slowly abraded to be slowly reduced in thickness.

It is also noted that the segments of the diamond tool of Comparative Example 4 laden with the filler at an excessively high concentration were slowly reduced in thickness, but were reduced in cutting rate.

EXAMPLE 5

Three diamond tools in the form of saw blades were produced and subjected to a cutting test to measure the cutting rate and wear performance of the diamond tools. The results are given in Table 4. The diamond tool of Example 5-1 was formed to have an alternate arrangement of triple-layered segments each regularly set with diamonds in three layers and double-layered segments each regularly set with diamonds in two layers (segment arrangement: 3×2). The diamond tool of Example 5-2 was formed to have a sequential arrangement of a triple-layered segment, a double-layered segment, and two random segments each randomly set with diamonds (segment arrangement: 3×2×random×random). The diamond tool of Comparative Example 1 was formed to have the arrangement of segments each randomly set with diamonds (segment arrangement: random) as described in Example 1.

In the three diamond tools, an Fe—Ni based alloy was used as a metal powder, and diamonds of MBS 955 manufactured by GE Company Ltd. of the USA were used. The sintering was processed through a hot press process at 950° C. for 5 minutes.

In each of the three diamond tools, sixteen segments were welded to a 9" diameter steel core through a laser welding process. In the cutting test, each diamond tool cut granite to a depth of 20 mm. The cutting test was performed with a 9" grinder manufactured by Bosch Company Ltd. and operated at 6,500 rpm.

The segments of each diamond tool each had a length of 38 mm, a height of 7.2 mm and a thickness of 2.4 mm.

TABLE 4

| Example No. | Segment arrangement | Concentration (cts/cc) | Cutting rate (g/min) | Cutting rate (%) | Wear performance (g/mm) | Wear performance (%) |
|---|---|---|---|---|---|---|
| Ex. 5-1 | 3 × 2 | 0.6 | 480.8 | 132 | 3.132 | 120 |
| Ex. 5-2 | 3 × 2 × random × random | 0.6 | 451.4 | 124 | 2.720 | 104 |
| Com. Ex. 1 | Random | 0.6 | 364.2 | 100 | 2.606 | 100 |

In Table 4, Ex. stands for Example, and Com. Ex. stands for Comparative Example.

From Table 4, it is apparent that the diamond tool of Example 5-2 is reduced in its cutting rate and wear performance in comparison with the diamond tool of Example 5-1, but is improved in its cutting rate and wear performance in comparison with the conventional diamond tool of Comparative Example 1.

As described above, the present invention provides a segment type diamond tool. In the diamond tool of this invention, the diamonds of the segments are arranged such that the diamonds of a trailing segment form grooves on the surface of a brittle substance along the lands between grooves previously formed on the surface of the brittle substance by the diamonds of a leading segment. Due to such an arrangement of diamonds on the segments, the diamonds more effectively cut the surface of the brittle substance in a cutting process, and so the diamond tool has an increased cutting rate, in addition to reducing the amount of fine debris generated during a cutting process.

In addition, the segments of the diamond tool of this invention are each set with diamonds in a single-layered structure or a multi-layered structure in an effort to allow the diamonds to more effectively cut the surface of a brittle substance in a cutting process, with a proper filler added to a desired portion of each segment. Therefore, the diamond tool of this invention has an increased cutting rate and improved wear performance, in addition to reducing the amount of fine debris generated during a cutting process.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A diamond tool comprising a plurality of segments including diamonds for cutting a brittle substance, sintered metal powder for attaching the diamonds to the segments, and a steel core, wherein:

the plurality of segments includes a leading segment and a trailing segment;

the diamonds of said each segment have a multi-diamond layered structure wherein the diamond layers are arranged with a gap in a direction perpendicular to a cutting direction;

the diamond layers of said each segment are arranged such that grooves are formed on the surface of the brittle substance by diamonds of the leading segment, and additional grooves are subsequently formed by the diamonds of the trailing segment, along lands between the grooves formed by the diamonds of the leading segment;

each of the layers has diamond lines having a plurality of diamonds arranged in a line parallel to the cutting direction on a plane parallel to the cutting surface of the segment, with no gap between the diamond lines; and each of the gaps between the diamond layers of the leading segment has a width less than a thickness of each diamond layer of the trailing segment.

2. The diamond tool according to claim 1, wherein the diamonds are irregularly set in a part of diamond layers of each segment or all the diamond layers of each segment so as to allow the diamond layers to appear as bands on a cutting surface of the segment.

3. The diamond tool according to claim 1, wherein a filler is distributed to diamond-free outer side portion of each segment.

4. The diamond tool according to claim 3, wherein said filler is selected from the group consisting of SiC, WC, BN, $Al_2O_3$, diamond, and mixtures thereof.

5. The diamond tool according to claim 4, wherein said filler is the diamond, and is distributed to the diamond-free outer side portions of each segment, with a concentration of the diamond used as the filler being set to 10~60% of a concentration of the diamonds set in each diamond layer of the segment used for cutting.

6. A diamond tool comprising a plurality of segments including diamonds for cutting a surface of a brittle substance, sintered metal powder attaching the diamonds to the segments, and a steel core, wherein:

each of said segments is divided into two or more sections consisting of a leading section and one more trailing sections;

the diamonds of said each section have a multi-diamond layered structure wherein the diamond layers are arranged with a gap in a direction perpendicular to a cutting direction;

the diamond layers of said each section are arranged such that the diamonds of each trailing section form grooves on a surface of the brittle substance along lands between grooves previously formed on the surface of the brittle substance by diamonds of the leading section;

each of the layers has diamond lines having a plurality of diamonds arranged in a line parallel to the cutting direction on a plan parallel to the cutting surface, with no gap left between said diamond lines;

and each of the gaps between diamond layers of the leading section has a width less than a thickness of the diamond layer of the trailing section.

7. The diamond tool according to claim 6, wherein the diamonds are irregularly set in a part of the diamond layers of each segment or all of the diamond layers of each segment so as to allow the diamond layers to appear as bands on a cutting surface of the segment.

8. The diamond tool according to claim 6, wherein a filler is distributed to diamond-free outer side portion of each segment.

9. The diamond tool according to claim 7, wherein a filler is distributed to diamond-free outer side portion of each segment.

10. The diamond tool according to claim 8, wherein the filler is selected from the group consisting of SiC, WC, BN, $Al_2O_3$, diamond, and mixtures thereof.

11. The diamond tool according to claim 10, wherein the filler is the diamond, and is distributed to the diamond-free outer side portions of each segment, which a concentration of the diamond used as the filler being set to 10–60% of a concentration of the diamonds set in each diamond layer of the segment used for cutting.

* * * * *

UNITED STATES PATENT AND TRADEMARK OFFICE

CERTIFICATE OF CORRECTION

PATENT NO. : 6,626,167 B2
DATED : September 30, 2003
INVENTOR(S) : Soo Kwang Kim et al.

It is certified that error appears in the above-identified patent and that said Letters Patent is hereby corrected as shown below:

Column 9,
Line 3, after “arrangement” insert -- : --.

Column 14,
Line 6, after “one” insert -- or --.

Signed and Sealed this

Sixth Day of April, 2004

JON W. DUDAS
*Acting Director of the United States Patent and Trademark Office*